US009242459B2

(12) United States Patent
Michallon

(10) Patent No.: US 9,242,459 B2
(45) Date of Patent: Jan. 26, 2016

(54) PRINTING AN AUTHENTICATION PATTERN WITH MULTI-DEFLECTION CONTINUOUS INKJET PRINTER

(71) Applicant: MARKEM-IMAJE HOLDING, Bourg les Valence (FR)

(72) Inventor: Jannick Michallon, Saint Peray (FR)

(73) Assignee: MARKEM-IMAJE HOLDING, Bourg-les-Valence (FR)

( * ) Notice: Subject to any disclaimer, the term of this patent is extended or adjusted under 35 U.S.C. 154(b) by 0 days.

(21) Appl. No.: 14/396,725

(22) PCT Filed: Apr. 24, 2013

(86) PCT No.: PCT/EP2013/058533

§ 371 (c)(1),
(2) Date: Oct. 23, 2014

(87) PCT Pub. No.: WO2013/160368

PCT Pub. Date: Oct. 31, 2013

(65) Prior Publication Data

US 2015/0116398 A1 Apr. 30, 2015

(30) Foreign Application Priority Data

Apr. 24, 2012 (FR) ..... 12 53769

(51) Int. Cl.
*B41J 29/38* (2006.01)
*B41J 2/13* (2006.01)
(Continued)

(52) U.S. Cl.
CPC .... *B41J 2/13* (2013.01); *B41J 2/02* (2013.01); *B41J 2/085* (2013.01); *B41J 2/09* (2013.01);
(Continued)

(58) Field of Classification Search
CPC ..... B41J 29/393; B41J 11/008; B41J 2/2135; B41J 2/21; B41J 2/02; B41J 2002/022; G06F 21/608; G06F 3/1239; G06F 21/31; G06F 3/1238
USPC ..... 347/9, 13–15, 73–76; 358/1.11, 1.14, 358/1.15
See application file for complete search history.

(56) References Cited

U.S. PATENT DOCUMENTS 4,384,295 A 5/1983 Lewis et al.
4,757,187 A 7/1988 Millet
(Continued)

FOREIGN PATENT DOCUMENTS

CN 1956848 (A) 5/2007
CN 101391521 (A) 3/2009
(Continued)

OTHER PUBLICATIONS

International Search Report for International Application No. PCT/EP2013/058533 dated Mar. 12, 2014.
(Continued)

*Primary Examiner* — An Do
(74) *Attorney, Agent, or Firm* — Miles & Stockbridge P.C.

(57) ABSTRACT

A method for printing an authentication pattern wherein, using a multi-deflection continuous inkjet printer, the pattern is printed on a substrate and only contains a small number of black pixels per raster. The resolution in the travel direction X of the substrate and in direction Y of the rasters is thereby largely improved compared with printing in dot-matrix mode, which makes reproduction of the pattern difficult for an infringer not having means to determine the electric charge to be applied to each of the droplets of a train of droplets needed to print each raster of the pattern.

23 Claims, 4 Drawing Sheets

(51) Int. Cl.

| | |
|---|---|
| ***B41J 2/085*** | (2006.01) |
| ***B41J 2/09*** | (2006.01) |
| ***B41J 2/18*** | (2006.01) |
| ***B41J 2/02*** | (2006.01) |
| ***B41J 29/393*** | (2006.01) |

(52) U.S. Cl.
CPC *B41J 2/18* (2013.01); *B41J 29/393* (2013.01); *B41J 2002/022* (2013.01); *B42D 2035/14* (2013.01); *B42D 2035/16* (2013.01)

(56) References Cited

U.S. PATENT DOCUMENTS

| | | | | |
|---|---|---|---|---|
| 4,883,291 | A | 11/1989 | Robertson | |
| 5,003,612 | A | 3/1991 | Millet | |
| 5,513,563 | A | 5/1996 | Berson | |
| 5,594,478 | A * | 1/1997 | Matsubara et al. | 347/41 |
| 7,731,435 | B2 | 6/2010 | Piersol et al. | |
| 7,948,652 | B2 * | 5/2011 | Noguchi et al. | 358/1.8 |
| 8,764,145 | B2 * | 7/2014 | Moriai et al. | 347/10 |

FOREIGN PATENT DOCUMENTS

| | | | |
|---|---|---|---|
| CN | 10160908 (B) | | 11/2011 |
| EP | 0 020 997 | A1 | 1/1981 |
| EP | 0 036 788 | A1 | 9/1981 |
| EP | 0 960 027 | B1 | 4/2001 |
| EP | 2 166 472 | A1 | 3/2010 |
| FR | 2 565 383 | A1 | 12/1985 |
| FR | 2 603 721 | A1 | 3/1998 |
| GB | 1 491 234 | | 11/1977 |
| GB | 1 533 659 | | 11/1978 |
| WO | WO 97/06009 | | 2/1997 |

OTHER PUBLICATIONS

International Preliminary Examination Report dated Oct. 24, 2014 for International Application No. PCT/EP2013/05833.

French Search Report for French Application No. 1253769 dated Mar. 19, 2013.

Issued Office Action dated Sep. 6, 2015, for Chinese Application No. 2013800333751, with English language translation.

Kipphan, H., Handbook of Print Media, Springer, Berlin/Heidelberg/New York (2000).

Van Renesse, R. L., "Optical Document Security (Third Edition)", Artech House, Boston/London (2005).

Office Action dated Nov. 20, 2015 for European Patent Application No. 13 719 801.6.

* cited by examiner

FIG.3
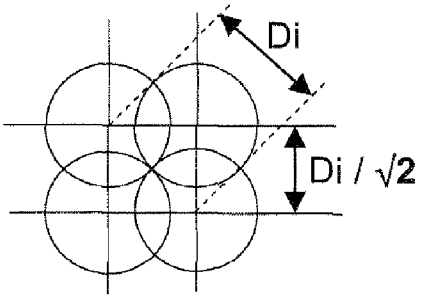
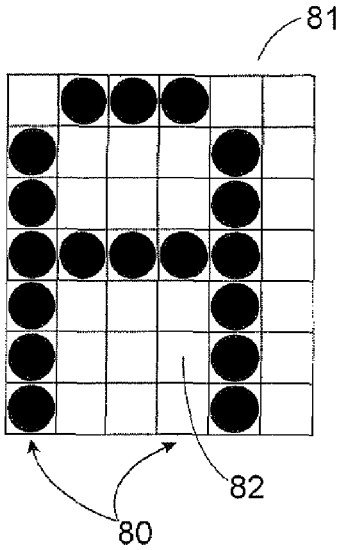
FIG.4A
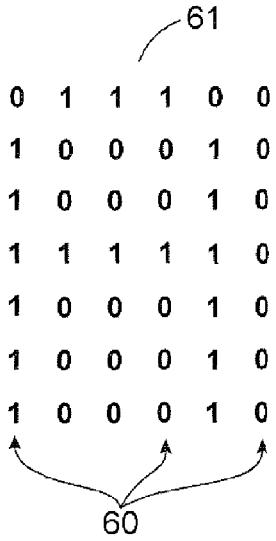
FIG.4B
Figure 5A
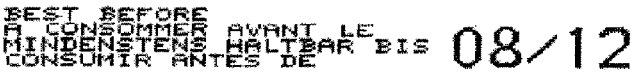
Figure 5B
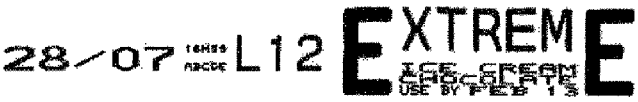

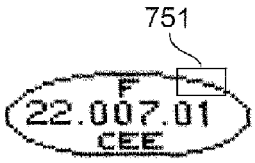
Figure 6A
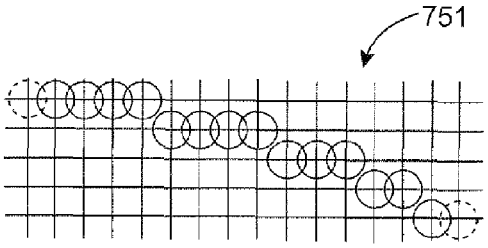
Figure 6B
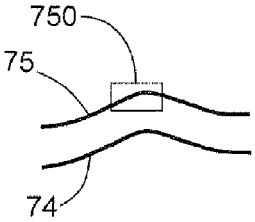
Figure 7A
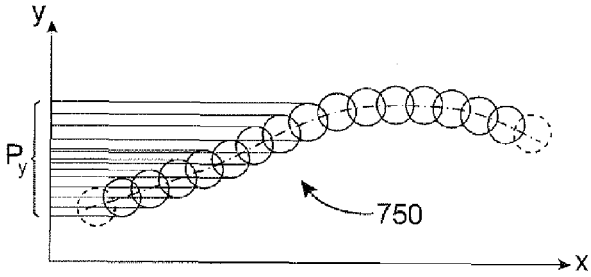
Figure 7B
Figure 8A
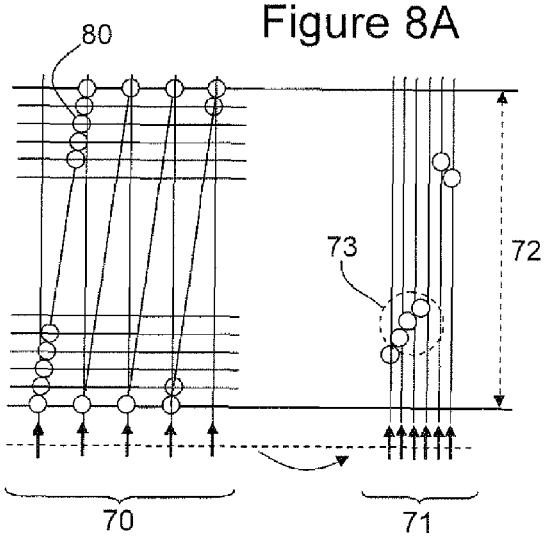
Figure 8B
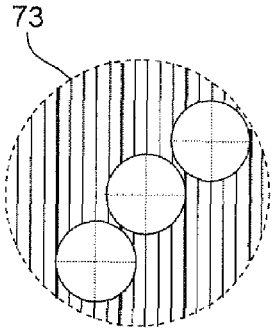

Figure 9A
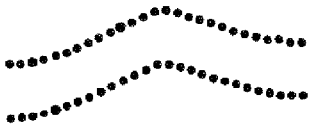
Figure 9B
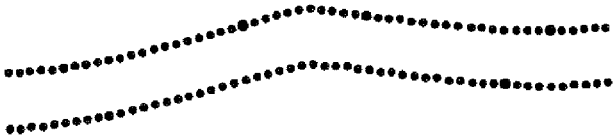
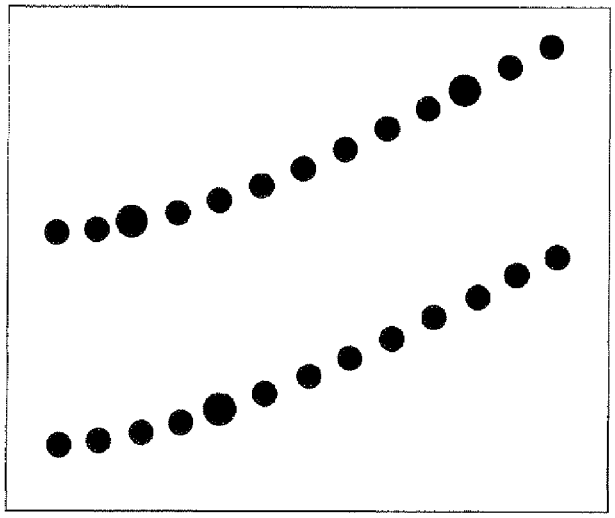
Figure 10

PRINTING AN AUTHENTICATION PATTERN WITH MULTI-DEFLECTION CONTINUOUS INKJET PRINTER

TECHNICAL FIELD

The invention concerns multi-deflection continuous inkjet printers.

It more particularly concerns authentication marking printed using a multi-deflection continuous inkjet printer. The marking is notably intended to be printed on each of the products or packs of mass-marketed goods or a group of these products forming a batch. It also concerns a print command method for a multi-deflection continuous inkjet printer. It further pertains to a data medium that is computer readable and contains instructions to be performed by the computer, these instructions when executed implementing the print method of the invention. Finally it relates to a printer equipped with command means capable of carrying out the print method of the invention.

PRIOR ART

The massive infringement of mass-marketed products often assumes the form of identical imitation of the pack or packaging of the product with exact replication of the identification label. This replication is made using identical labels to those of the genuine products and printed using the same printing technology. Infringers use commercially available industrial printers.

Various methods have been disclosed in an attempt to make fraudulent imitations more difficult, and to facilitate the recognition of such imitations.

U.S. Pat. No. 4,757,187 by Millet assigned to the present Applicant discloses a marking method in which a printer A connected to a packaging line C receives command instructions from a terminal B. Terminal B is directly under the control of a control organization whose role is to control the authenticity and number of marked products. The printer operates in graphic mode and only operates the function of generating the mark to be printed. The mark to be printed is stored at terminal B and is therefore permanently controlled by the control organization. Therefore each time the mark is printed, the control organization at terminal B is able to record the marking and to count the number of print occurrences.

Patent application FR 2 565 383 by Millet discloses a method in which authentication is ensured by adding a programmed defect to standard writing.

Some inkjet printing technologies, using printers of drop-on-demand type, allow the size of the drops to be managed by acting on the drop ejection controls. This possibility is used by U.S. Pat. No. 5,513,563 to Berson. According to this patent, some data are encrypted. The encrypted data are processed to obtain bit-by-bit representation of the encrypted data. A map of the bits is memorized. At the time of printing, those bits in the map having a value of 1 are caused to correspond to a large drop and the bits having a value of 0 correspond to a smaller drop. The data thus encoded are printed in one or more specific regions of the whole print-out.

U.S. Pat. No. 7,731,435 by Piersol et al assigned to Ricoh discloses a method for printing an electronic document in which recognition of the authenticity of the document is ensured by encryption and decryption having recourse to the intrinsic qualities of the illumination of a sheet and of the sheet itself containing the encrypted data.

U.S. Pat. No. 4,883,291 to Robertson discloses the marking of a manufactured article by stamping alphanumeric characters on a surface of the article. The characters are produced in a form able to be recognized by the human eye depending on their shape and orientation. The characters are formed of selected pixels arranged in a matrix which, for all the characters, has the same number of rows and columns. All the characters have the same number of black pixels, and each character is a predetermined and unique combination of said number of pixels.

The above-cited specific examples of anti-infringement protection are only a selection from among others. Numerous anti-infringement methods exist which, for example, use holographic labels, special inks, RFID tags (radio frequency identification), a unique code per individual product associated with a remote database which can be consulted on the Internet or by telephone.

DISCLOSURE OF THE INVENTION

Known systems providing efficient protection against infringement are complicated to implement and/or are costly in terms of unitary extra cost on each marked product and in terms of investment.

In terms of investment, the setting up of known anti-infringement solutions often requires modifications to existing production installations and organization. Also, known methods using remote databases accessible via Internet require an available connection close to the production line. The verifying of authenticity generally necessitates specific means: special lighting for fluorescent inks, RFID tag reader, connection means to a remote database, to cite just a few examples.

The imitating of identification labels on infringing products is all the easier since these labels are printed using technology available to all.

There is therefore a need for a protection method against infringement that is particularly adapted to mass-marketed products of low unit market value.

The invention first concerns an authentication pattern printed by a multi-deflection continuous inkjet printer on a printing substrate, the pattern being defined by a group of white and black pixels, the pattern consisting of a succession of screens or rasters spaced apart in a direction X as per a raster pitch, each raster having a direction substantially parallel to a direction Y perpendicular to direction X, all the black pixels of one raster lying at a distance from an axis of direction X, that is preferably continuously between a minimum distance and a maximum distance, or being preferably continuously distributed in direction X and/or in direction Y, each raster comprising no more than three black pixels.

The number of rasters particularly depends upon the available space for marking the authentication pattern on the substrate, and upon the resolution or raster pitch in direction X.

According to one example, the authentication pattern may comprise the representation of at least one line of line-drawing type or at least two lines of line-drawing type, which may be parallel to each other.

A line graphics can be a single line or combination of several lines, each line comprising, or being defined by, a succession of impacts of drops or droplets, where each impact may or not overlap the neighbouring impact. At least one line or each line may extend along a 2D trajectory or 2D path, not necessarily along a particular single straight direction or along a single straight line. Therefore, it can represent a wave form, or a loop, or a smooth curve, or a spiral line.

As will be explained in more detail below, the fact that the number of printable droplets of one raster is limited to a small number, preferably assuming the value of 1, 2 and no more than 3, the resolution in direction X can be strongly increased compared with the possibility provided by dot-matrix printing. Also, the position of the impacts can be defined continuously along axis Y. In this manner, the authentication pattern has an appearance that anyone is able to recognize immediately without any particular tooling, after brief training.

In theory, nothing limits the size of the pattern in direction X, since the number of rasters is any number. On the other hand, the pattern is printed on a substrate e.g. a can, bottle, jar, carton whose dimensions are finite. The pattern is therefore limited by the contour of the locally planar or near-planar region on which it is printed.

Here and in the remainder hereof, the expression "black pixel" is used to designate a pixel on which an ink droplet is present, irrespective of the colour of this ink and the volume of the ink droplet. The expression "white pixel" designates a pixel on which no ink has been sprayed. A white pixel has the background colour of the substrate irrespective of this colour.

According to one aspect, at least one black pixel of an authentication pattern has a size (or diameter) greater than that of one or more other pixels, or is missing. This is made possible using for example a multi-deflection continuous inkjet printer by spraying onto said pixel of larger size an ink droplet formed by the coalescence of two or more droplets. From the viewpoint of the number of pixels per raster, a large pixel formed by the coalescence of two or more droplets is considered to be a single pixel.

The invention also concerns a series of patterns, each being such as described above, wherein at least one of said authentication patterns comprises at least one alteration compared with the other authentication patterns.

This relates to a series of patterns printed on a series of media.

In said series, at least one of said authentication patterns may have at least one pixel of different size to the same pixel or corresponding pixel in the other authentication patterns and/or have at least one missing black pixel compared with the other authentication patterns.

According to another aspect, each authentication pattern in the series may be different from each of the other authentication patterns in the same series.

In particular the alteration(s) may be:

- a function of so-called authentication data: this is data contained in another marking, called an identification marking, associated with the corresponding authentication pattern;
- and/or comprise at least one impact of large diameter whose number is directly the numerical value of the authentication data (in the above-indicated meaning) or a simple function of this value (twice, one half, . . . ),
- and/or comprise at least one large diameter impact whose distribution defines encoding of the value of the authentication data (in the above-mentioned meaning).

In other words, when the media successively come before the print head, the authentication patterns which are successively printed on each of the media in the succession may be identical to each other. However, patterns that are apparently identical to a first authentication pattern in their general form may slightly differ from each other to a greater or lesser extent through the fact that a small number of pixels are of greater size than the other pixels or through the fact that a small number of black pixels are missing. By a small number of pixels differing in size or missing is meant for example a number lower than one fifth of the number q of rasters forming the pattern.

This aspect makes it possible to differentiate between apparently identical patterns through the adding of a small difference which can be detected by a trained eye. It is therefore possible to further complicate an infringer's task by modifying the appearance of the authentication pattern in a manner known to the person printing the authentication pattern. It is possible for example to correlate the number or the positions of large-size pixels or the number or positions of missing pixels, with information given elsewhere on the substrate.

The invention also concerns a pattern printed on a print substrate, this pattern comprising a group of white and black pixels, and comprising a succession of rasters spaced apart in a direction X, each raster having a direction substantially parallel to a direction Y substantially perpendicular to direction X, this pattern comprising:

- a first zone comprising identification marking, being defined by a group of white and black pixels, this marking comprising a succession of rasters spaced apart in a direction X as per a raster pitch, each raster having a direction substantially parallel to a direction Y perpendicular to direction X;
- and, associated with each identification marking, a second zone comprising an authentication pattern such as described above.

Advantageously, the raster pitch of the identification marking in direction X is greater than the raster pitch of the authentication pattern.

The identification marking is preferably in dot-matrix mode.

It is also possible according to the invention to produce a series of these patterns whereby at least one of said authentication patterns comprises at least one alteration compared with the other authentication patterns.

Therefore, at least one of the authentication patterns may have at least one pixel of different size to the same pixel or corresponding pixel in the other authentication patterns and/or at least one missing black pixel compared with the other authentication patterns. Each authentication pattern may differ from each of the other authentication patterns in the series.

The alteration or alterations:

- may be a function of a data item of the identification marking corresponding to or associated with the authentication pattern;
- and/or may comprise at least one large-diameter impact whose number is directly the numerical value of the identification data item or a simple function of this value e.g. is proportional to this value;
- and/or may comprise at least one large-diameter impact whose distribution defines encoding of the value of the identification data item.

It is therefore possible to produce a series of authentication patterns whereby each pattern in the series is printed on a substrate on which an identification marking is also present printed in dot-matrix mode by a multi-deflection continuous inkjet printer, the marking printed in dot-matrix mode containing visible information, and in which the differing of an authentication pattern from one series to another through the number or positions of the pixels or through pixels that are missing or of larger size than the others results from the application of a code applied for example to a visible data item indicated in the identification marking. For example, the identification marking contains a visible data item which is reproduced in coded manner in the number and/or positions of the large-size pixels in the authentication pattern.

Whether or not authentication patterns are produced alone or in combination with identification markings, authentication patterns differing from each other can be printed on a rotating basis on printing substrates successively coming before the print head, or they can be chosen for each substrate randomly or pseudo-randomly from among the plurality of possible patterns.

To print the authentication patterns and optionally the identification markings such as those above, it is possible to use a multi-deflection continuous inkjet printer, for example of the type used to print markings on mass-marketed goods. Said printer may already be installed on a production line. The unit incremental cost for printing an authenticating label or more generally an authentication marking is almost negligible.

Verification of the authenticity of the label does not require any particular means; in particular an attentive observer will be able without any particular accessory means but merely on observing the marking, to detect whether or not it is an infringed marking or an authentic marking. Said method, which makes large-scale infringement most complicated, will be efficacious even if the individual protection of each product is not very strong. Attempted fraudulent reproduction of the marking perhaps remains possible, but there is a small probability that a reproduction made with means available on the market could have the appearance of an authentic marking. In addition, it would require extensive research investment by the infringer, which would be discouraging.

Marking, in particular an authentication marking or pattern, according to the invention can be applied in particular to a substrate formed by the packaging of a product for example, such as a pack, this packaging possibly being in paper, cardboard or plastic, or else a bottle or metal pack.

It may also be applied to a label placed on or intended to be placed on either the product or object itself, or on a substrate or on packaging of this product or this object e.g. of the above-mentioned type.

It may also be applied to the surface of a product or object.

An authentication marking or pattern according to the invention can therefore be on the surface of a product or object to be authenticated or on a packaging of this product or object.

The invention also concerns a method for commanding the printing of a multi-deflection continuous inkjet printer or print head of said printer so as to print, in particular on one of the media just mentioned above, a marking comprising no more than three black pixels per raster on a substrate traveling relative to the head in direction X.

Prior to printing, the following operations may have been carried out:

a) the number of rasters q needed to print the marking is determined;

b) for each raster of rank s between 1 and q, the value is determined of the electric charge to be applied to each of the droplets of a train of W consecutive droplets so that some droplets are deflected to impact the printing substrate solely at each of the positions where a black pixel is present in said raster of rank s;

c) in a group of addresses of rank s the values are memorized of said electric charges for each of said W droplets, d) steps b) and c) are stopped as soon as rank s becomes higher than q).

From a practical viewpoint, steps a) to d) are performed by consultation between the printer designer and the user. The user defines the pattern, optionally with the help of the designer of the printer. It is then the designer of the printer who determines the number W of droplets which will be needed and the values of the electric charge of each of the W droplets to be applied to each of the successive rasters. Since, in each raster, there are a small number of printable droplets, the number W of droplets common to all the rasters may also be small. On this account, as explained above, the droplet charge command mode allows the positioning of the droplets in direction Y to be varied continuously between a most deflected position of the droplet and a least deflected position of the droplet.

Then, if a pattern is to be printed:

e) it is verified that the spatial frequency of reception of signals signalling the position of the substrate is a spatial frequency for the printing of an authentication pattern, and if this is not the case the current frequency is replaced by a spatial frequency for the printing of an authentication pattern;

f) it is waited for reception of a first signal signalling the position of the substrate;

g) each of the W consecutive droplets, after the first positioning signal, is charged at the respective charge levels defined by the W values memorized in the group of addresses of rank 1;

h) step g) is recommenced each time a new positioning signal is received by charging the W droplets, after receiving a position signal of rank s, at the charge values memorized in the group of addresses of rank s.

i) the printing of the pattern is stopped when the rank of the position signal becomes higher than rank q.

Steps e) to i) are performed when the printer is used to print authentication messages.

The position signals derived from the substrate or position signals constructed from position signals derived from the substrate are spaced by a time spacing which may be equal to or longer than the jet flow time needed to produce W droplets. Preferably this time spacing is equal to the jet flow time to produce W droplets.

As is explained below, with this characteristic it is possible, for a given rate of travel of the substrate, to reduce the raster pitch to its possible maximum and thereby also obtain greater resolution in direction X.

The invention also concerns a print command method for a multi-deflection continuous inkjet printer or a print head of said printer to print at least one authentication pattern on a printing substrate, using a multi-deflection continuous inkjet printer or print head of said printer, this pattern comprising a group of white and black pixels, this method comprising the printing of a succession of rasters separated as per a raster pitch in a direction X, each raster having a direction substantially parallel to a direction Y substantially perpendicular to direction X, all the black pixels of one raster lying at a distance from an axis of direction X that is, preferably continuously, between a minimum distance and a maximum distance, each raster comprising no more than three black pixels.

Said pattern may have one of the particular characteristics already set forth above for authentication marking.

According to another aspect, the invention also concerns a method such as described above, whereby a multi-deflection continuous inkjet printer or print head of said printer is used to print:

- a first zone comprising identification marking defined by a group of white and black pixels, this marking comprising a succession of rasters spaced apart in a direction X as per a raster pitch, each raster having a direction substantially parallel to a direction Y perpendicular to direction X;
- and, associated with each identification marking, a second zone comprising an authentication pattern according to a method such as set forth above.

According to one of its aspects, a further subject of the invention is the printing on a printing substrate of one or more markings comprising a group of white and black pixels, this method comprising the formation in this order or in reverse order of a marking (e.g. by printing of dot-matrix type) called identification marking and a so-called authentication marking by a succession of rasters spaced apart in a direction X as per a raster pitch, each raster having a direction substantially parallel to a direction Y substantially perpendicular to direction X, all the black pixels of one raster lying at a distance from an axis of direction X between a minimum distance and a maximum distance, each raster of the authentication marking comprising no more than three black pixels, and the raster pitch of the identification marking being greater than the raster pitch of the authentication marking.

According to another aspect, the invention also concerns a method for commanding the printing of a multi-deflection continuous inkjet printer or print head of said printer, to print at least one marking on a printing substrate, of the type already described above, this method comprising the formation of bursts of droplets for each of the marking zones, each burst being intended to form a raster on the printing substrate, the bursts being formed at a first frequency for the identification zone, and at a second frequency higher than the first for the authentication zone.

Modification of the frequency occurs on the changeover from printing one of the two zones to printing the other zone, or else the raster pitch can be modified between the printing of the identification zone and the printing of the authentication zone, irrespective of the order of printing of these zones.

The invention allows the printing of an authentication pattern on a substrate, this pattern only containing a small number of black pixels per raster. The resolution in direction X of travel of the substrate and in direction Y of the rasters is then largely improved compared with printing in dot-matrix mode, which makes reproduction of the pattern difficult for an infringer not having the means to determine the electric charge to be applied to each of the droplets of a train of droplets required to print each raster of the pattern.

In one of the methods such as defined above, at least one black pixel of the authentication pattern may be of larger size than the others or may be missing.

According to one example, the authentication pattern represents at least one line of line-drawing type.

Said method can allow the printing of a plurality of patterns, at least one of the authentication patterns comprising at least one alteration compared with the other authentication patterns.

At least one of said authentication patterns may have at least one pixel of different size to the same pixel or corresponding pixel of the other authentication patterns and/or have at least one missing black pixel compared with the other authentication patterns. In addition, each authentication pattern may differ from each of the other authentication patterns.

The alteration(s) may be or may comprise one or more of the characteristics already indicated above.

Preferably, the raster pitch of the identification marking in direction X is greater than the raster pitch of the authentication pattern, the raster pitch being modified between the printing of the identification zone and the printing of the authentication zone, irrespective of the order of printing of these zones.

The invention also relates to a multi-deflection continuous inkjet printer provided with command means allowing the printing of an authentication pattern such as set forth above.

If the printing is performed both of identification marking and of authentication marking at the same time, it is possible during one same pass in front of the printer of the article to be authenticated, to print both the authentication pattern and the identification marking. This latter marking is printed in dot-matrix mode whereby the number N of consecutive droplets from which the printing droplets of one raster are extracted is different from the number W, for example at least twice greater. It is effectively sought to impart a visible difference in appearance between the types of printing (for identification marking and authentication marking). This difference in appearance being partly related to the resolution along axis X, it is possible to control this appearance by causing a variation in the parameter or parameters which will cause this resolution to vary. Preferably, the changeover from the dot-matrix print mode to the print mode for authentication marking (or according to steps e) to i) above), is or can be programmed.

If the changeover is programmed, this means that one or more zones of the substrate have previously been determined as identification zones, and that one or more zones of the substrate have previously been determined as authentication zones. If the changeover is programmable, this means that one or more zones of the substrate or substrates can be programmed by the user as identification zones and that one or more zones of the substrate or substrates can be programmed by the user as authentication zones.

According to this modality, the invention relates to a multi-deflection continuous inkjet printer or print head of said printer provided with command means to print authentication marking such as defined above.

Preferably, the printer is also provided with command means allowing printing in dot-matrix mode by spraying ink droplets each forming a black pixel of the marking, to print alphanumeric or graphic characters in different fonts, and mode switching means allowing a changeover from printing in standard dot-matrix mode to printing in authentication marking mode and conversely.

Finally, the invention relates to a permanent storage medium storing data readable by a computer or by control means of a multi-deflection continuous inkjet printer, or to a plurality of such storage media, the data notably comprising instructions which can be executed by the control means of the printer and which, when these are executed, make a multi-deflection continuous inkjet printer capable of implementing the method to print an authentication pattern. The permanent storage medium or plurality of such media storing data readable by a computer or control means of a multi-deflection continuous inkjet printer may also contain the instructions and data required for printing in standard dot-matrix mode and the instructions to switch between the standard dot-matrix mode and the print mode chosen to print the authentication pattern.

The data medium may particularly comprise one or more optical discs, one or more cassettes, one or more hard disks or even one or more digital data storage keys.

From a practical viewpoint, currently available printers comprise a data medium carrying instructions making a multi-deflection continuous inkjet printer capable of carrying out printing in standard dot-matrix mode. It is possible to add to the command means of said printer one or optionally several data media comprising data and instructions making the printer capable of printing one or more authentication patterns differing from each other and of switching the print mode to switch from the standard print mode to a mode in which the authentication pattern or one or several of the authentication patterns are printed. Finally, for a newly purchased printer, one single printing substrate may contain the data and instructions to print in standard mode or the particular mode to print an authentication mark.

With the invention it is possible to create and print on each product, using a multi-deflection continuous inkjet printer and on at least one zone of each product called an authentication zone, a mark called an authentication pattern printed using non-dot matrix mode(s) which impart a most unusual appearance to the printing. This or these non-standard print modes use internal functions of the printer and in particular the application of any given voltage to a given droplet and the commanded triggering of bursts (or micro-bursts) in real time which in general are not accessible to the user since such user does not have the technical information to act in controlled manner on the functions of a system as complex as a continuous inkjet printer. The functioning of this printer has recourse firstly to software and secondly to components some of which are dedicated to the printer itself, i.e. designed by the manufacturer and specifically manufactured, generally in ASIC form. The assembly is therefore highly complex and more or less inaccessible to a user.

The simulation, using standard dot-matrix modes of a printer, of the particular effect produced by these non-standard modes would be of such complexity or inefficacy that the advantage of large-scale infringement by imitation of the marking would be non-existent.

BRIEF DESCRIPTION OF THE FIGURES

Other advantages and characteristics of the invention will become better apparent on reading the detailed description given with reference to the figures among which:

FIG. 3 illustrates a group of pixels each formed by a print droplet. It is intended to explain the relationship between the diameter of the dot formed by an impact of an ink droplet on a substrate and the nominal print resolution.

FIGS. 4A and 4B respectively illustrate the manner in which a group of droplets together forms an alphanumeric character, through the presence and absence of a droplet impact on the different points of a matrix table (FIG. 4A) and the table entries (FIG. 4B) for this example of a character;

FIGS. 5A and 5B give examples of markings printed using the standard dot-matrix mode;

FIGS. 6A and 6B illustrate another example of a marking printed in standard dot-matrix mode (FIG. 6A) and a much enlarged part 751 of this marking (FIG. 6B);

FIGS. 7A and 7B give an example of an authentication pattern printed using the invention (FIG. 7A) and a much enlarged part 750 of this pattern (FIG. 7B);

FIGS. 8A and 8B illustrate a succession of rasters printed in dot-matrix mode at the fastest rate possible with this mode and rasters printed according to the invention at the same rate of travel of the substrate (FIG. 8A), and an enlargement of a zone 73 of this second part;

FIGS. 9A and 9B illustrate two examples of authentication patterns printed using the mode particular to the invention;

FIG. 10 shows a magnified detail of one of the patterns in FIGS. 9A and 9B.

DETAILED DESCRIPTION OF PARTICULAR EMBODIMENTS

Figure 1:
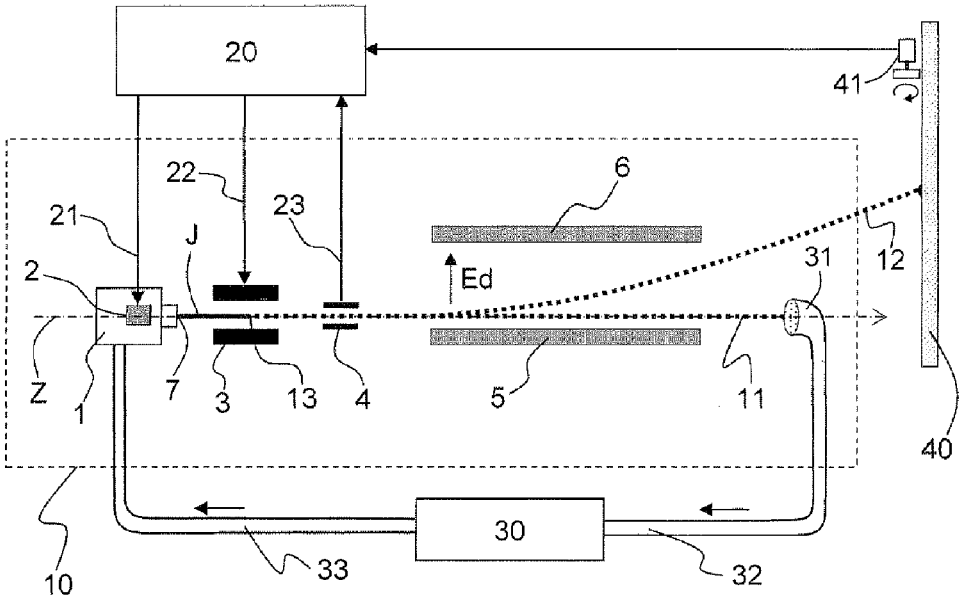
FIG. 1 is a schematic illustration of the main elements together forming an example of embodiment of a multi-deflection continuous inkjet printer.

First the structure and functioning of a multi-deflection continuous inkjet printer is recalled.

A distinction is made between two major categories of inkjet printers: printers of "drop-on-demand" type and continuous inkjet printers. Among the latter, a distinction is made between binary deflection continuous inkjet printers and multiple deflection continuous inkjet printers. It is the latter that are the most used for printing identification markings on mass-marketed products on account of their high speed and capacity to print on media which are not fully planar.

They are used for example to mark eggs, objects in plastic such as insulated electric cables, food industry products and many others besides.

According to one of its aspects, the invention uses a multi-deflection continuous inkjet printer. The structure and functioning of said printer will be recalled with reference to FIG. 1 so as to show how a set-up difficulty of these printers can be put to advantageous use by the invention to implement an anti-infringement method.

Multi-deflection continuous inkjet printers are composed of 3 main sub-assemblies added to a body of the printer not illustrated in the Figure:

- an ink circuit 30,
- a print head 10 notably comprising an ink droplet generator 1,
- a controller 20 for which it is assumed for the needs of the present description that it groups together all print command means.

The main function of the ink circuit 30 is first to deliver ink to the droplet generator 1 at adequate pressure and viscosity and adequate impurity level, and secondly to recycle the ink from those parts of the jets that are not used for printing.

The print head 10 is generally offset from the body of the printer; it is connected thereto by an umbilical cable grouping together the hydraulic 32, 33 and electric 21, 22, 23, connections required for the print head 10 to operate. One example of a print head is described in patent EP 0960 027 B1 published in April 2001 in connection with FIG. 1 and paragraph 0016 of this patent. The head 10, from upstream to downstream in the direction of flow of the inkjet, comprises:

- the ink droplet generator 1 fed with electrically conductive ink and capable of ejecting a continuous jet J through an ejection nozzle 7. The initial trajectory of the jet therefore merges with the axis Z of the nozzle 7;
- one or more charge electrodes 3;
- a sensor 4 detecting the charge actually carried by an ink droplet is illustrated since some printers are provided therewith;
- one or more deflector electrodes 5, 6 deflecting the droplets electrically charged by the charge electrodes 3;
- a collection gutter 31 to collect ink not used during printing.

The generator 1 additionally comprises means 2 for stimulating the ink.

In FIG. 1, reference 40 designates a printing substrate which may, for example, be:

- the packaging surface of a product, such as a pack, this packaging possibly being in paper or cardboard or plastic, or even a bottle or metal pack;
- a label positioned or to be positioned either on the product or on the object itself, or on a substrate or packaging e.g. of the aforementioned type for this product or this object;
- or else the surface of a product or object.

These given examples are non-limiting.

The operating principle of said printer is the following.

The jet J permanently ejected along axis Z is constantly and periodically broken at a precise point 13, called the break-up point, under the periodic action of the stimulation means 2. It is then transformed into a succession of regularly spaced droplets.

The charge electrodes 3 placed in the vicinity of the break-up point 13, electrically charge the droplets when so commanded. The instant of droplet charging is preferably synchronized with the instant of break-up of the jet J by means of the presence of the sensor 4.

The droplets 11 not intended for printing are not or are only scarcely charged and are directed towards the gutter 31 then recycled by the circuit 30.

The droplets 12 intended for printing are electrically charged and deflected from their initial ejection trajectory along axis Z of the nozzle 7 of the droplet generator by the deflector electrodes 5, 6 between which an electrostatic field is maintained. The droplets 12 intended for printing impact a printing substrate 40. The droplets can be charged individually at variable values in relation to the electric voltage applied to the charge electrodes 3 at the time of break-up. The amplitude of their angle of deflection depends first on the quantity of electric charges they receive and secondly on the dwell time in the deflection field, directly related to the velocity of these droplets.

Figure 2:
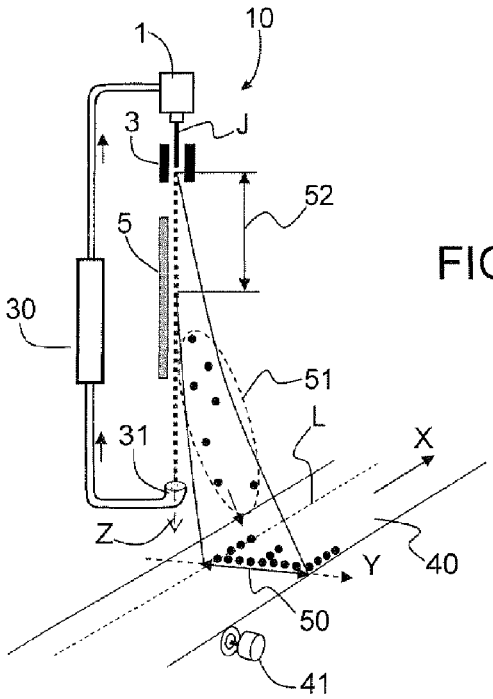
FIG. 2 is a schematic view showing how a multi-deflection continuous inkjet printer prints a substrate traveling in relation to a print head of the printer.

The trajectory of the droplets will now be commented on in connection with FIG. 2.

The printing substrate 40 travels in direction X. Its position relative to the print head is detected. "Strokes" (or signals) indicating the relative position between head and printing substrate are emitted by means 41 detecting the travel of the substrate 40 in direction X. These position signals are received by the print command means 20. The position signals are counted by the command means 20.

In relation to printing speed and the marking to be printed, the print command means 20 send to the charge electrodes 3 the voltage values to be applied. Each charged droplet gains velocity in a direction Y perpendicular to direction Z. The arrangement of the deflector electrodes 5, 6 is such that direction Y is perpendicular to the travel direction X of the substrate.

Let us now consider a fictitious straight line L of the printing substrate parallel to direction X which we will call a "print line". By convention, it will be said that among the charged droplets, one droplet which is the least charged will position itself on the print line L. A droplet that is most charged will position itself at a maximum distance from the print line. For an instant position of the substrate relative to the print head, the print head ejects a train of N consecutive droplets. Depending on the number and the position of the droplets which lie at said position on the substrate, for the purpose of printing, some droplets are charged and some droplets are non-charged or scarcely charged.

Among the N droplets of the train of N droplets of the jet, the group 51 of charged droplets, called a burst, will impact the printing substrate at a distance of greater or lesser length from the print line L, along a straight line segment 50 perpendicular to the print line i.e. parallel to direction Y.

The print segment 50 is considered to be perpendicular to the print line L insofar as the travel of the substrate during the time of the burst can be considered negligible. The droplets that are not or scarcely charged are collected in the collection gutter 31.

The length of the print segment 50 is a function of the distance between the deflector electrodes and the substrate, of the difference in charge between the strongest and weakest electric charge which can be applied to a print droplet, and finally of droplet velocity. The length of a raster is therefore no more than the distance between a least charged print droplet and a most charged print droplet. A raster is printed at each of the successive positions of the substrate 40.

For each position along a raster, a level of electric charge for a droplet allocated to this position is determined and allocated to said droplet. As explained in paragraph 0031 of patent EP 0960 027 already cited, or in columns 5 and 6 of U.S. Pat. No. 4,384,295, the trajectory of a droplet is perturbed by the charge of neighbouring droplets and by the aerodynamic effect created by the droplets immediately preceding a given droplet.

The aerodynamic perturbations on a given droplet are chiefly due to:

- first, the wake (aerodynamic drag) of one or more droplets projected into the air in front of the given droplet causing acceleration of the latter associated with deflection from its trajectory,
- or secondly, the slowing to which the droplet is subjected when it has to enter the air at high speed with respect to ambient air.

There may also be perturbations related to air flows circulating in the print head, strongly depending on the configuration of the space within which the droplets circulate, on the pressurisation characteristics of the print head, and/or on the flows generated by pressure equilibration in the print head.

Electrostatic perturbations on the trajectory are related to the electrostatic forces undergone by the charged droplets when they approach or draw close to each other during their flight. All such behaviour leads to several types of undesirable effects:

- the trajectories of droplets having one same charge will not be identical for different configurations, different relative positions and different charges of surrounding droplets;
- some interaction situations between droplets lead to instability making control over the trajectory impossible, it not being possible to reach the desired point of impact, or which cause coalescence of droplets which have drawn too close to one another. In this case, the only possibility is to distance the droplets away from each other during their flight. This can be obtained by inserting non-charged droplets, called guard droplets, between charged droplets and/or by managing the charging order of the jet droplets so that no droplet is too close to another.

In practice, no analytical computing is made of the charge level of a droplet moving in a print head of given geometry to determine a precise trajectory of this droplet, taking into account the configuration of the droplets in flight by which it is surrounded, since the physical model is too complex. Determination of the droplet charge voltage by these means is not achievable by a printer controller.

A printer designer and manufacturer therefore has recourse to an experimental characterization method using specific tools with which it is possible successively to place the droplet in given situations in which it is surrounded by other droplets, and for each situation to identify its trajectory or impact position and to cause the charge voltage to vary until its trajectory is the expected trajectory. In particular, it is possible to observe the passing droplets using a synchronized camera and to measure their position at the point of impact. This position can then be associated with the charge voltage of the droplets which is adjusted to obtain the desired position. The data linking the charge voltage with the trajectory in a given environment can be memorized and when an identical situation (characterized by the desired trajectory and the environment) is requested of the printer, the charge voltage of the droplet can be determined from the memorized data and applied to the droplet.

Since the deflected trajectory of a droplet can be continuously variable between the minimum deflection and maximum deflection allowed by the size of the head, and since it is more or less influenced by the charge and the position of several tens of other surrounding droplets, it has been sought to limit the number of situations to be taken into account.

One solution to restrict the number of situations to be taken into account is dot-matrix printing which allows any symbol to be represented with a limited number of printable positions. These positions are distributed over a grid whose pitch along X and pitch along Y determine the resolution of the image. In this case, there only exists a restricted number M of trajectories to reach the positions of the grid in direction Y of deflection. M is the number of positions in direction Y. It corresponds to the number of rows of the print matrix. M is chosen on criteria of minimum print speed to be reached and the quality of graphical representation of symbols, typically from 5 to 32 positions.

Nevertheless, even it were desired with dot-matrix printing to conduct prior experimental determination and memorizing of the charge level of the droplets for each of their trajectories, giving consideration to all possible configurations of the other droplets in flight, the number of tests to be carried out would become considerable and unrealistic as soon as M becomes large, typically >9. Therefore, for example when M=9 the number of arrangements of droplet positions corresponds to all the configurations of a binary number of 9 bits i.e. $2^9=512$ possible arrangements.

One reasonable solution consists of giving attention to only a limited number of so-called influential droplets whose presence or absence modifies—most significantly with respect to a criterion of precision impact positioning—the value of the charge level of the droplet under consideration to maintain its trajectory. The number of tests to determine experimentally the charge level or the differences in charge level for all possible cases therefore becomes feasible. More or less sophisticated solutions were developed in the prior art (EP0036788, GB 1 533 659, GB 1 491 234) firstly to treat the effect of the most influential droplets precisely and the effect of the less influential droplets more globally, and secondly to optimize the order of ejection of the droplets as a function of their deflection.

In the remainder of the text, the designation train of droplets is given to the N consecutive droplets used to print a raster in standard dot-matrix mode, or the W droplets used to print a raster in authentication mode.

A burst, as seen above, groups together the droplets which among the N or W droplets are sufficiently electrically charged to have a trajectory which ends on the printing substrate. For as long as these droplets are between the print head and the substrate they are part of the burst, when all the droplets of the burst have impacted the substrate the term raster is used.

The data obtained during prior experimental tests are stored in memory means, for example in the form of a database which can be used by the controller 20 to compute the corrected charge level of the droplets deflected in the bursts. The controller also determines, in the train of N droplets of the jet portion from which each burst is drawn, those droplets which will be part of the burst.

Let us turn our attention to the resolution of the images produced by a multi-deflection continuous inkjet printer. Resolution is expressed in Dpi for example (Dot per inch), which is the distance between consecutive impacts.

Along a raster in dot-matrix printing there are a number M of possible positions for the print droplets. The maximum number M of positions for the print droplets forming a raster is a function of printing resolution.

The marking formed by an isolated raster may be a straight segment if the raster comprises one droplet on each of the M possible positions. It may also be a set of dashes and dots. A dash is formed by at least two droplets occupying positions adjacent to each other in the raster, a dot is formed by a droplet occupying a position between two droplet-free positions in the raster. Finally, a raster may not comprise any print droplet. The marking to be printed is therefore formed by the assembly of successive rasters.

The droplets ejected between two consecutive trains are systematically directed towards the gutter.

The triggering of a burst occurs in relation to the travel of the substrate, for example under the control of a tachometric signal synchronous with the travel of the substrate and emitted by means 41 (see FIG. 2). With this functioning it is possible to disregard variations in speed of the substrate since even if the time frequency of this signal varies as a function of the rate of travel of the substrate, its spatial frequency remains constant and corresponds to a pulse for a number m of traveled μm.

Nominal resolution is defined in relation to the impact diameter of the droplets Di. If it is considered that resolution is identical in direction X of travel of the substrate and in direction Y of deflection, there exists a particular resolution which allows the entirety of the surface of the substrate to be just covered with ink, when X is perpendicular to Y. This resolution corresponds to a distance between consecutive droplets in direction X or in direction Y equal to $Di/\sqrt{2}$. This definition of nominal resolution, as illustrated in FIG. 3, allows two diagonally adjacent droplets of the matrix to be tangent to each other. The resolution corresponding to $Di/\sqrt{2}$ is generally chosen as basic or nominal resolution by the person skilled in the art. It defines the maximum number and possible positions of consecutive impacts able to be placed on the impact segment when this segment is placed at a nominal distance from the head. Under these nominal conditions, the points of impact correspond to the intersection of the impact segment with very precise trajectories of the deflected droplets. If the head/substrate distance is not nominal, resolution changes to higher if closer and to lower if further distant. In addition, this characteristic can be used to adjust resolution in relation to the needs of the industrial application.

An example of a symbol is illustrated in FIG. 4A, it is the letter A written in a matrix table 81 having 7 rows (M=7) and 6 columns 80. The possible impact positions 82 of a segment of impacts together forming a column 80 of the matrix table 81 may or may not be occupied. The impact segment 80 the furthest to the left in the matrix table 81 comprises the depositing of a droplet on each of the positions 82 except one. There are then 3 impact segments 80 with the depositing of one droplet on only 2 positions 82 of the segment, followed by the further depositing of a droplet on all the positions 82 of the segment except 1. Finally, a last impact segment 80 does not comprise any deposit.

Each impact segment is defined by a description or a binary description. A description contains binary words indicating the presence translated as 1 or absence translated as 0 of impacts for each possible position 82 of an impact segment 80. Each symbol therefore has a corresponding matrix 61 illustrated in FIG. 4B. The matrix 61 has the same number of rows and columns (or binary description) 60 as the matrix table 81.

The designer of a printer therefore builds a set called a "font" of predefined symbols each entered into a matrix table 81, for example alphanumeric characters, codes in particular bar codes, graphics. Each matrix table 81 forms a sub-assembly of the font. With multi-deflection continuous inkjet printers, all the matrix tables 81 of a font generally have the same number R of columns and are therefore described with the same number R of binary words. A font is therefore characterized first by the numbers R and M defining its matrix and secondly by the graphical representation allocated to each symbol, this graphical representation for each symbol corresponding to the set 61 of binary words 60 defining said symbol.

The controller of the printer is able, when so commanded, to compose markings comprising a juxtaposition of sets 81 of symbols (words, numbers) and to manage the printing sequences allowing bursts of droplets to be ejected in accordance with the sequence of binary words 60 together forming the marking to be printed.

For each of the binary descriptions 60, a burst of droplets 51, schematically illustrated in FIG. 2, is triggered at each of the successive positions of the substrate coinciding with a column of the matrix table 81. Each burst of droplets derives from a portion 52 of the jet. The jet portion 52 from which a burst is derived is composed of a train of N consecutive droplets of the jet. Among the N droplets, a number p of droplets is deflected and forms the burst. The number p is equal to the number of "1" entered into the binary description 60 of the impact segment 80 to be printed. The number N of droplets from which the p droplets of a burst are extracted is constant.

The charge value of each of these N droplets can be determined using an algorithm, based on the description or the binary description to be printed, this being an input parameter of the algorithm. The algorithm output is the value of the charge levels to be applied to each of the droplets as a function of its rank in the train of N droplets of the jet portion 52 so that p droplets impact the substrate at the position indicated in the binary description. All the graphical combinations of impacts on the matrix can therefore be printed when requested.

Each print trigger command to print a column of impacts given by the travel system of the substrate (and generated by the means 41) initializes the start of a train of N droplets.

The designer and manufacturer of the printer supplies a user with the means to transcribe the graphical definition of the symbols in matrix form within a message into a command process for the printer which produces the jetting of corresponding droplets. For the printer user, the marking to be printed is translated in the form of a succession of symbol codes e.g. ASCII code enabling the use of a standard keyboard. Each code corresponds to the graphical description of a matrix symbol, memorized and stored in memory means in the form of a font of characters, characterized in particular by the size of the matrix table. The user may also have access to the graphical preparation of the fonts of matrix symbols using tools that are supplied and after previously choosing the characteristics of a matrix among the different matrixes offered by the manufacturer.

The dot-matrix print mode just described can be implemented on a multi-deflection continuous inkjet printer.

FIGS. 5A and 5B show two scanned examples of messages produced in dot-matrix mode, containing identification data of mass-marketed products. These messages are edited from different fonts supplied by the printer manufacturer. In the case shown in FIGS. 5A and 5B, each message forms the marking to be printed on each of the items of products to be identified. The message may comprise parts which are identical from one product item to another and parts which vary according to the rank of the item in a series. For example, in the example shown FIG. 5A, "best before . . . " is printed on all the items but the date which follows is variable depending on the rank of the item.

The functioning mode of multi-deflection continuous inkjet printers described above shows that any anti-infringement method using the means accessible to the user, such as the composing of particular coded messages or/and the preparation of a font of specific symbols, will not be very robust. If a specific matrix font is prepared by the user or by the manufacturer at the user's request, an infringer will easily be able to identify the descriptions of the font symbols and to reproduce or have these reproduced by a manufacturer.

In the dot-matrix functioning mode of a multi-deflection continuous inkjet printer just described, a burst which may contain a number of droplets of between 0 and M, is formed for each position of the substrate which corresponds to a position of a printable column in the matrix table.

Each burst corresponds to a jet portion 52 allowing the formation of a number N>M of droplets. The speed of the jet being constant and the frequency of jet break-up also being constant, the printing time of an impact segment is always equal to the time T of the formation of N droplets. If the rate of travel of the substrate is such that the time for passing from one printable position to the next is higher than T, some droplets will be sent to the gutter between two consecutive printings of segments.

The maximum operating speed is reached when the time T becomes equal to the time needed for the substrate to move from one printable position to the next consecutive printable position.

It is noted that in this case and as illustrated on the left in FIG. 8A (which schematically illustrates the printing of a message comprising an identification 70 zone, printed in dot-matrix mode), one printed segment 80 is no longer perpendicular to direction X, since the time T is no longer negligible compared with the travel time of the substrate 40 from one printable position to the next. In this case, the printed segment forms an angle slightly greater than 90° with direction X. This is why it is said that the raster is substantially perpendicular to the travel direction X of the substrate. It is possible however to maintain perpendicularity, even at high printing speeds. For example, it is described in document EP 0 960 027 how to orient the deflector electrodes so that the deflected droplets contain a velocity component in the direction of travel of the substrate. This technique can be applied to the teaching of the present application.

The dot-matrix mode therefore allows a message called an identification message to be formed such as the one already described above in connection with FIGS. 5A and 5B, and which contains a certain number of data items such as the name of the product and/or its date of manufacture and/or its packaging date . . . . However, this information is insufficient to authenticate the packaged product i.e. to determine for example whether or not its origin is controlled by the distributor thereof.

To understand the authentication technique proposed below, an explanation will now be given of a "micro-burst": this is a burst in which some droplets of reduced number (e.g. one or two droplets) are deflected. The number of droplets in the jet portion to create a micro-burst is also very low (e.g. 5 droplets). These micro-bursts can be sequenced at a faster rate than the bursts used for dot-matrix printing since the number of droplets to create a burst of dot-matrix type is substantially higher than the number needed to create a micro-burst. These "micro-bursts" will be used when producing an authentication message. As a result, the spatial frequency of the signal from the means 41 can be modified (in general by the printer controller during the print sequencing of a message) when switching from the dot-matrix mode (to produce an identification message) to the so-called authentication mode which will allow a so-called authentication message to be printed.

The spatial frequency of the signal for a dot-matrix zone is therefore lower or even substantially lower than that for an authentication zone.

The micro-bursts are preferably sized so that, at maximum printing speed i.e. in general when the bursts of dot-matrix printing are sequenced without any waiting time, they themselves are sequenced with a minimum waiting time between each one (ideally with no waiting time). Nominally, a micro-burst only ejects a deflected droplet, but for reasons set forth below the number of droplets in the jet portion associated with a micro-burst comprises a higher number of droplets. The non-printable droplets are guard droplets whose presence, when designing the authentication symbol, allows the choosing of the droplet that is to be deflected from among the droplets in the associated jet portion. This makes it possible:

first, to optimize management of the interactions between droplets in flight, to make the trajectories as insensitive as possible to printing speed;

and secondly to improve the graphics of symbols at high speed by more fine-tuned positioning of the droplets on the travel axis X of the substrate.

The presence of guard droplets also provides the possibility of charging more than one droplet in the micro-burst. This allows the placing of more than one impact on the corresponding impact segment in order to increase graphical capacity when designing authentication symbols or to cause the coalescence of 2 droplets deliberately to obtain an impact of larger diameter. We will return to this aspect later.

In addition, the designer and manufacturer of multi-deflection continuous inkjet printers has the means to develop an operating mode with which it is possible to allocate any charge level to each of the droplets ejected in the jet. This possibility is used to place the droplets at any position along the axis Y between the least deflected position and the most deflected position of a burst.

It will be understood from the foregoing that it is therefore possible, on a substrate to be printed, to obtain zones having spatial frequencies (or resolutions) which differ along X and/or Y.

This results in portions of messages having a certain appearance and portions of messages having another appearance, the difference in appearance resulting from the difference in spatial frequencies or resolution.

According to one aspect of the invention, this makes it possible to cause symbols to occur, in the printed authentication zone, whose appearance is different or very different from the printing of the symbols using standard dot-matrix mode. This particular aspect is related firstly to an increase, and in some cases to a strong increase, in the resolution of the symbols printed in this zone compared with the dot-matrix zone (or compared with the so-called identification zone of the product).

It is therefore possible to create authentication markings containing graphics, for example line graphics, in particular having more or less continuous shapes and of unique appearance or at all events not used in the usual identification zones. A line-drawing pattern may be a set of lines constructed by means of impacts arranged on each of the lines. Each line may be different from a straight line; for example it may represent a wave form, or a loop, or a smooth curve, or a spiral line. The different lines may be parallel to each other or interlaced or intersecting.

A line graphics can be a single line or combination of several lines, each line comprising, or being defined by, a succession of impacts of drops or droplets, where each impact may or not overlap the neighbouring impact. At least one line or each line may extend along a 2D trajectory or 2D path, not necessarily along a particular straight direction or along a straight line. Therefore, as explained above, it can represent a wave form, or a loop, or a smooth curve, or a spiral line.

Each of the successive rasters along direction X comprises drop impacts disposed along said 2D trajectory or 2D path. For each pitch or each position along direction X the impacts of the drops or droplets are on the intersection of the screen or raster with the 2D trajectory or 2D path.

FIG. 6A shows graphic printing, in particular a curve of ellipse shape, formed using standard dot-matrix mode and of which part 751 is largely magnified in FIG. 6B. The drawing of the line shows an irregular shape, including notches or aliasing, characteristic of this type of printing.

It can be seen in FIG. 6B that part of the ellipse forming a gentle slope is formed by a succession of small horizontal dashes offset in direction Y by a height equal to the distance separating two consecutive rows of the matrix. One row which encompasses impacts of droplets is therefore formed by horizontal dashes and by dashes lying at 45° to directions X or Y.

Through this example, it is understood that in dot-matrix mode a continuous line of any shape is approximated by a succession of impacts forming a succession of lines in directions X, Y or at 45° to these directions.

FIGS. 7A and 7B show a sample printing of a simple line pattern, formed of two smoothed parallel lines 74 and 75, printed in authentication mode, FIG. 7B showing an enlarged portion 750 of row 75. In the particular case illustrated, the rasters only comprise a single printable droplet per raster and the droplet of a raster has alternately been directed towards row 74 or towards row 75. It is also possible for example to print a pattern of three lines, by addressing the printable droplet of a one-droplet raster towards one of the lines in turn. For a raster with two printable droplets and a pattern with 3 lines, it is possible in turn to eliminate the droplet which should be addressed to one of the lines. A much enlarged part of row 75 is illustrated in FIG. 7B. This Figure also shows axes X and Y identical or parallel to the axes X and Y in FIG. 2. It can be seen that, by projection along axis Y, the pattern finishes a projection zone Py which is continuous. This is also the case, in this example, with projection Px of the pattern along axis X.

The difference in appearance, between printing in dot-matrix mode illustrated in FIGS. 6A and 6B and printing in authentication mode illustrated in FIGS. 7A and 7B, essentially derives from the differences in resolution along X and Y. In the print mode for authentication marking, preferably a maximum number of black pixels which may be contained in a raster is chosen, this being 1, 2 or 3 and preferably being 1. On the other hand, the position of these pixels may be any position at all between the position of a most deflected droplet and the position of a least deflected droplet. Therefore the resolution in direction Y is high or very high or increased compared with this resolution in dot-matrix mode. Since the number of black pixels is small, the number of droplets W in a train of droplets for printing a raster is also small. On this account, the resolution along X may also be increased in good proportions compared with the best resolution along X that can be obtained with standard dot-matrix mode. On account of these differences in resolution along X and Y, the appearance of a curve of any shape, printed in authentication mode, can be clearly distinguished by the naked eye, or in the absolute extreme under a magnifying glass, from the appearance which the same curve printed in dot-matrix mode could have. To form an authentication pattern, it is possible for resolution to differ solely along X or solely along axis Y if in this latter case the difference in appearance is sufficiently visible.

More detailed explanations concerning the improvement in resolution along X, made possible by this method, will be given with reference to FIGS. 8A and 8B.

FIG. 8A schematically illustrates the printing of a message comprising an identification zone 70 printed in dot-matrix mode as explained above. FIG. 8A on the right side also comprises an authentication zone 71 printed in the above-described authentication mode. One portion 73 of this authentication zone is also magnified in FIG. 8B. In FIGS. 8A and 8B, each droplet impact is symbolically represented by a circle centred on the position of the droplet. These circles do not represent the size of the droplet impacts but only their positions.

In the example in FIG. 8A, four consecutive rasters of an identification marking 70 are printed in dot-matrix mode, at the maximum possible speed. This means that the time for producing a train of N droplets is equal to the travel time of the substrate in direction X from one printing position to the next consecutive position. N may be 24 droplets for example for a matrix raster of M=16 printable positions. The burst triggering signals then follow immediately in sequence, or in other words there are no droplets between two consecutive trains. It is notably ascertained that the printed rasters 80 are slightly tilted at an angle from the axis Y.

On the right side of the example illustrated in FIG. 8A, the printer has switched over to the printing mode for printing an authentication pattern 71 and has printed 6 rasters comprising no more than one black pixel per raster. The number of droplets W of the train of droplets in the jet to create the burst here is 5 for example.

As already explained above, the maximum printing speed in this case is the speed at which the train of W droplets allowing the printing of a raster containing no more than one black pixel lasts a time that is equal to the travel time of the substrate between two consecutive position signals. Therefore at a constant travel rate of the substrate, the spatial spacing of the position signals can be smaller for printing with a small number of black pixels per raster, than for dot-matrix printing. On this account the resolution along X is improved.

In practice, the spatial frequency of the burst triggering signals is modified, as shown in FIG. 8A, when the printing of the message changes over from an identification zone 70 to an authentication zone 71 and conversely. To return to the chosen example, at the maximum printing speed the period of the trigger signals in the identification zone 70 corresponds to the ejection time of 25 droplets by the jet (printed droplets plus guard droplets), whilst in the authentication zone it corresponds to the ejection time of 5 droplets. In general, this period of the trigger signals is therefore shorter in an authentication zone than in an identification zone. Similarly, the frequency of its signals is higher in an authentication zone than in an identification zone. In the example given here, the frequency ratio of the trigger signals is 5 (25/5); this is also the ratio of the resolution along axis X obtained for printing of the authentication marking 71 to the resolution along this same axis obtained for printing of the identification marking 70. In this manner, the time signal remains controlled by the spatial position signal and, like this signal, varies in the event of acceleration or slowing of the substrate.

The forming of an authentication pattern was explained above in relation to the forming of an identification marking. However authentication marking can be produced independently of identification marking: the continuous nature of this authentication marking, which is explained above with reference to FIG. 7B, effectively allows an appearance to be imparted thereto that can be recognized by a user. In this case, the authentication pattern is printed in the manner explained above, with a trigger frequency of trigger signals adapted to obtain this appearance. If, subsequent to a preceding printing operation, this frequency is the frequency only used to print identification marking, it is then switched to a higher value adapted to the printing of an authentication pattern.

In other words, it is possible to have on a substrate:

identification marking and authentication marking;

or solely authentication marking.

Another aspect of the invention will now be explained. This aspect can be applied to an authentication pattern, whether or not printed next to or in connection with identification marking.

It is effectively possible, by acting on the charge levels of the droplets, to cause the coalescence of 2 droplets in flight and to control the trajectory of this double-sized droplet so that it reaches the substrate, for example at the same point as for an impact provided in the initial symbol.

Coalescence occurs when 2 drops in flight draw close with sufficient kinetic energy to overcome electrostatic repelling forces. As soon as physical contact is made between the two droplets they are mutually absorbed under the effect of surface tension to minimize the overall surface area of the new droplet whose volume has doubled and the charge has assumed the accumulated value of the 2 preceding droplets.

The impact obtained on the substrate will be substantially larger, hence in general detectable with the naked eye having regard to the size of droplets in CIJ technology, and of highly specific nature compared with the double impact of 2 isolated droplets. As a result, according to this aspect of the invention, the variable elements of the symbol can be constructed from the presence or absence, at given points, of impacts of large diameter.

In FIGS. 9A and 9B, two examples are given of authentication patterns each in the form of two wavy lines.

These patterns have alterations in the form of impacts of large diameter in lieu and stead of normal impacts. The resolution along the travel axis X of the substrate has been reduced here to make the phenomenon visible with the naked eye. The symbol in FIG. 9A has been altered with 3 impacts of large diameter, and the one in FIG. 9B with 5 impacts distributed over the 2 smoothed lines.

As a general rule, it is found that the number of types of patterns that can be created with a small number of black pixels in a raster is limited. They are preferably line patterns allowing substantiated improvement in resolution along X and Y.

In the examples illustrated in FIGS. 9A and 9B, the pixels forming a line are slightly non-contiguous but placed with high resolution. In addition, some pixels of the pattern are formed by a large droplet, the large droplet being obtained by the choice of charges to be applied to the droplets of the train so that two droplets of one burst aggregate over their pathway.

A magnified version of the difference in pixel size is illustrated in FIG. 10, which allows the ascertaining that the impacts of large diameter are of circular shape which would not be possible with a double impact of droplets from the jet.

It is noted in this case that the initial number of droplets in the burst may be higher than the number of impact points in the raster. The means for obtaining this in controlled manner are within the reach of the manufacturer of the printer but scarcely accessible to third parties acting on the printing machine. It is also possible to eliminate some droplets from the marking. On account of the non-contiguous nature of the impacts, it is easier to identify the positions of the large pixels, or absences of pixels.

These possible replacements on some positions of the authentication pattern 71 of one pixel by a pixel of larger size than the other pixels or the possible elimination of said pixel, make it possible when printing a series of authentication patterns which are apparently all identical to a first pattern, to add a slight difference or alteration or modification between patterns of the series.

The modification of a pattern in the series can be correlated, in manner known per se, with data relating to the printing rank for example of the pattern within a batch and to the rank of the batch in a series of batches, or even relating to information visibly indicated in the identification marking.

This makes it possible to understand how controlled alterations can be inserted in authentication symbols 71.

These alterations may be fixed, intrinsically variable or variable as a function of a data item that itself is variable (for example data of time-stamping type and/or a code and/or batch number and/or random number . . . ) visibly printed in a dot-matrix zone 70 identifying the product. The visual detection of these variable changes in the authentication zone does not give rise to any particular problem and the correlation between the authentication data item and the configuration of the alterations can be made accessible to an observer having no special skills.

Other (non-exhaustive) examples can be given of the case in which large diameter impacts are used:

the number of large diameter impacts present in the authentication symbol is directly the numerical value (e.g. if the identification marking gives the indication of the hour of manufacture of the product, this may be the figure of the tens of minutes of this hour) of the authentication data item or a simple function of this value (twice, one half, . . . ); as already explained above by "authentication data item" is meant herein information contained in another marking, in fact the identification marking, associated with the corresponding authentication pattern; in other words it is information contained "visibly" in the identification part which is then encoded in the form of one of alterations in the authentication marking, and/or the distribution of the large-diameter impacts defines encoding of the value of the authentication data item (using coding for example such as the principle of binary or Morse coding).

More sophisticated coding can be used combining several data items and several types of variable elements (graphical and large-diameter impacts) or several types of arrangements of variable elements (for example 2 data items encoded on 2 sub-assemblies of the authentication zone).

The possibilities are numerous: the authentication data item may be any element of the identification information of the product visibly printed in the dot-matrix identification zone, and the arrangement of the graphical alterations and/or large-diameter impacts in the authentication zone is extensively free.

The insertion of variable alterations in the authentication symbol can be made according to the invention by modifying the control of the printers so that the print sequencing function integrates the encoding of the authentication data item and manages the insertion of variable alterations in the authentication symbol. This is generally performed by software dedicated to the application and which is developed by the manufacturer of the printer. A reinforced level of anti-infringement protection can thereby be obtained. Even having in possession the data of the authentication symbol is effectively not sufficient to implement the complete method. The variability of the alterations can be added during production, the alterations changing on each printing of each unit product or each batch of the product, the alterations not being changed for a certain number of consecutive printings.

Overall protection against infringement can be completed by encrypting the data describing the authentication symbol and/or by controlled access (e.g. a password).

The software integrated in the printer may additionally be protected by means known in the prior art. Production logistics can also be organized to further complicate the task of potential infringers, for example by regularly changing the authentication symbol in accordance with non-predictable criteria.

The invention claimed is:

1. A marking printed on a printing substrate, said printing substrate being the surface of an object or of a packaging of said object, said marking including a group of white and black pixels, and a succession of rasters spaced apart in a direction X as per a raster pitch, each said raster having a direction substantially parallel to a direction Y substantially perpendicular to direction X, said marking comprising:

a first zone comprising an identification marking of said object, said identification marking being in dot-matrix mode; and a second zone associated with said identification marking and comprising an authentication pattern representing at least one line of line-drawing type, wherein all said black pixels of a raster of said authentication pattern are disposed at a distance from an axis of the direction X that is continuous between a minimum distance and a maximum distance, and wherein each said raster comprises no more than three black pixels.

2. The marking according to claim 1, wherein, in the authentication pattern, a size of at least one of said black pixels is larger than a size of the others in said authentication pattern or is missing.

3. The marking according to claim 1, wherein the authentication pattern represents at least 2 lines of line-drawing type, parallel to each other.

4. The marking according to claim 1, wherein the raster pitch of the identification marking in the direction X is greater than the raster pitch of the authentication pattern.

5. A series of patterns, comprising:

a plurality of authentication patterns, each said authentication pattern comprising a marking printed on a printing substrate, said printing substrate being the surface of an object or of a packaging of said object, said marking including a group of white and black pixels, and a succession of rasters spaced apart in a direction X as per a raster pitch, each said raster having a direction substantially parallel to a direction Y substantially perpendicular to direction X, said marking comprising a first zone comprising an identification marking of said object, said identification marking being in dot-matrix mode; and a second zone associated with said identification marking and comprising an authentication pattern representing at least one line of line-drawing type, wherein all said black pixels of a raster of said authentication pattern are disposed at a distance from an axis of the direction X that is continuous between a minimum distance and a maximum distance, and wherein each said raster comprises no more than three black pixels, wherein at least one of said authentication patterns comprises at least one alteration compared with the other authentication patterns.

6. The series of patterns according to claim 5, wherein at least one of said authentication patterns has at least one pixel of different size with respect to a size of the same pixel or a corresponding pixel in the other of said plurality of authentication patterns, or has at least one missing black pixel compared with the other of said plurality of authentication patterns, or both.

7. The series of patterns according to claim 5, wherein each said authentication pattern is different from each of the other authentication patterns in the series.

8. The series of patterns according to claim 5, wherein said at least one alteration comprises at least one of:

a function of an authentication data item extracted from the identification marking corresponding to or associated with the authentication pattern;

at least one impact of large diameter whose number is directly a numerical value of the authentication data item or a simple function of said numerical value; and at least one large-diameter impact whose distribution defines encoding of the numerical value of the authentication data item.

9. The series of patterns of claim 8, wherein said large diameter is proportional to said numerical value.

10. A method for printing a marking on a printing substrate, said printing substrate being the surface of an object or of a packaging of said object, using a multi-deflection continuous inkjet printer or a print head of said printer, said marking including a group of white and black pixels, and a succession of rasters spaced apart in a direction X as per a raster pitch, each said raster having a direction substantially parallel to a direction Y substantially perpendicular to said direction X, the method comprising:

printing, in a dot-matrix mode, a first zone comprising an identification marking; and printing a second zone associated with said identification marking and comprising an authentication pattern representing at least one line of line-drawing type, wherein all said black pixels of one raster are disposed at a distance from an axis of the direction X that is continuous between a minimum distance and a maximum distance, and wherein each said raster comprises no more than three black pixels.

11. The method according to claim 10, wherein at least one black pixel of the authentication pattern is printed in a greater size than a size of the other pixels of said pattern or is missing.

12. The method according to claim 10, wherein a plurality of authentication patterns are printed, and wherein at least one of said plurality of authentication patterns comprises an alteration compared with the other authentication patterns.

13. The method according to claim 12, wherein at least one of said authentication patterns has at least one pixel of a different size with respect to a size of the same pixel or a corresponding pixel in the other of said plurality of authentication patterns, or has a missing black pixel compared with the other of said plurality of authentication patterns, or both.

14. The method according to claim 12, wherein each said authentication pattern is different from each of the other authentication patterns.

15. The method according to claim 10, wherein the raster pitch of the identification marking in the direction X is greater than the raster pitch of the authentication pattern, the raster pitch being modified between the printing of the identification zone and the printing of the authentication zone, irrespective of the order of printing of said identification zone and said authentication zone.

16. The method of claim 10, wherein said authentication pattern represents at least two lines of line-drawing type.

17. The method of claim 16, wherein said at least two lines of line-drawing type are parallel to each other.

18. A multi-deflection continuous inkjet printer or print head of said printer, comprising:

an ink circuit;

a print head; and a control and command unit configured to print a marking on a printing substrate, said printing substrate being the surface of an object or of a packaging of said object, using a multi-deflection continuous inkjet printer or a print head of said inkjet printer, said marking including a group of white and black pixels, and a succession of rasters spaced apart in a direction X as per a raster pitch, each said raster having a direction substantially parallel to a direction Y substantially perpendicular to said direction X, wherein said control and command unit is further configured to print a first zone, in a dot-matrix mode, comprising an identification marking; and wherein said control and command unit is further configured to print a second zone associated with said identification marking and comprising an authentication pattern representing at least one line of line-drawing type, wherein all said black pixels of one raster are disposed at a distance from an axis of the direction X that is continuous between a minimum distance and a maximum distance, and wherein each said raster comprises no more than three black pixels.

19. A non-transitory storage medium storing thereon data readable by a computer or by command means of a multi-deflection continuous inkjet printer, or a plurality of such media, the data comprising instructions executable by the printer command means and which when executed cause said multi-deflection continuous inkjet printer or print head to perform the following:

printing a marking on a printing substrate, said printing substrate being the surface of an object or of a packaging of said object, using a multi-deflection continuous inkjet printer or a print head of said printer, said marking including a group of white and black pixels, and a succession of rasters spaced apart in a direction X as per a raster pitch, each said raster having a direction substantially parallel to a direction Y substantially perpendicular to said direction X;

printing, in a dot-matrix mode, a first zone comprising an identification marking; and printing a second zone associated with said identification marking and comprising an authentication pattern representing at least one line of line-drawing type, wherein all said black pixels of one raster are disposed at a distance from an axis of the direction X that is continuous between a minimum distance and a maximum distance, and wherein each said raster comprises no more than three black pixels.

20. A method comprising:

commanding the printing of a multi-deflection continuous inkjet printer or print head of said printer, to print at least one marking on a printing substrate, said marking including a group of white and black pixels, and a succession of rasters spaced apart in a direction X as per a raster pitch, each said raster having a direction substantially parallel to a direction Y substantially perpendicular to direction X, said marking comprising a first zone comprising an identification marking of said object; and a second zone associated with said identification marking and comprising an authentication pattern, wherein all said black pixels of a raster of said authentication pattern are disposed at a distance from an axis of the direction X that is continuous between a minimum distance and a maximum distance, and wherein each raster comprising no more than three black pixels, and forming bursts of droplets for each of the marking zones, each burst being intended to form a raster on the printing substrate, each said burst being formed at a first frequency for the first zone, and at a second frequency higher than the first frequency for the second zone.

21. The method according to claim 20, wherein the frequency is modified from the first frequency to the second frequency, or from the second frequency to the first frequency, upon changeover from the printing of one said first and second zones to printing the other zone of said first and second zones.

22. The method according to claim 20, wherein the raster pitch of the identification marking is greater than the raster pitch of the authentication marking, the raster pitch being be modified between the printing of the first zone and the printing of the second zone, irrespective of the order of printing of the first zone and the second zone.

23. A multi-deflection continuous inkjet printer or print head of said printer, comprising:

an ink circuit;

a print head; and a control and command unit comprising a non-transitory storage medium storing thereon data readable by a computer or by command means of a multi-deflection continuous inkjet printer, or a plurality of such media, the data comprising instructions executable by the printer command means and which when executed cause said multi-deflection continuous inkjet printer or print head to perform the following printing a marking on a printing substrate, said printing substrate being the surface of an object or of a packaging of said object, using the multi-deflection continuous inkjet printer or a print head of said printer, said marking including a group of white and black pixels, and a succession of rasters spaced apart in a direction X as per a raster pitch, each said raster having a direction substantially parallel to a direction Y substantially perpendicular to said direction X;

printing, in a dot-matrix mode, a first zone comprising an identification marking; and printing a second zone associated with said identification marking and comprising an authentication pattern representing at least one line of line-drawing type, wherein all said black pixels of one raster are disposed at a distance from an axis of the direction X that is continuous between a minimum distance and a maximum distance, and wherein each said raster comprises no more than three black pixels.

* * * * *